United States Patent [19]

Lewis

[11] 4,213,017

[45] Jul. 15, 1980

[54] MULTIPLE SWITCH ASSEMBLY WITH DETENT AND INTERLOCK

[75] Inventor: Keith Lewis, Lancashire, England

[73] Assignee: Lucas Industries Limited, Birmingham, England

[21] Appl. No.: 876,927

[22] Filed: Feb. 10, 1978

[30] Foreign Application Priority Data

Mar. 26, 1977 [GB] United Kingdom ..... 12793/77

[51] Int. Cl.[2] ..... H01H 9/24

[52] U.S. Cl. ..... 200/5 B; 200/50 C; 200/153 J; 200/328

[58] Field of Search ..... 200/50 C, 5 B, 5 E, 200/5 EA, 5 EB, 153 J, 328

[56] References Cited

U.S. PATENT DOCUMENTS

| | | | |
|---|---|---|---|
| Re. 27,963 | 4/1974 | Schadow | 200/153 J X |
| 3,187,602 | 6/1965 | Cousins | 200/5 E |
| 3,260,802 | 7/1966 | Yamauchi et al. | 200/5 E |
| 3,663,780 | 5/1972 | Gulbeck | 200/159 R X |
| 3,722,313 | 3/1973 | Schadow | 200/5 E X |
| 4,071,719 | 1/1978 | Madland | 200/50 C X |

FOREIGN PATENT DOCUMENTS

| | | | |
|---|---|---|---|
| 1498611 | 10/1967 | France | 200/153 J |

*Primary Examiner*—James R. Scott
*Attorney, Agent, or Firm*—Holman & Stern

[57] ABSTRACT

Disclosed is a multiple switch assembly including first and second push-push switches positioned side by side. The operating member of the first switch carries a shoulder which cooperates with a peg on the second switch operating member so as to move the second switch along with the first switch when the first switch is moved from a first to a second position. Additionally the second switch carries a resilient strip which during movement of the second switch beyond its second position, is deflected towards and engages the first switch operating member. The resultant movement on the first switch operating member releases it from its detent such that by pushing said second operating member, said first and second switches are returned to their respective first positions. The resilient member acts as an effective interlock element to assist in the retention of the operating members in the depressed position and the automatic return of both operating members to the first position.

3 Claims, 5 Drawing Figures

MULTIPLE SWITCH ASSEMBLY WITH DETENT AND INTERLOCK

BACKGROUND OF THE INVENTION

This invention relates to an electrical switch assembly of the kind including first and second push-push switches.

The term push-push switch is used herein to mean an electrical switch having a body, an operating member slidable linearly relative to the body between first and second spaced positions, resilient means urging the operating member towards the first position, detent means for retaining the operating member in the second position, said detent means being releasable to permit return of the operating member to the first position by movement of its operating member from the second position beyond the second position against the action of the resilient means, and electrical contacts operated by movement of the operating member between said positions.

SUMMARY OF THE INVENTION

An electrical switch assembly according to the invention includes first and second push-push switches as hereinbefore defined said first and second switches being positioned side by side, the operating member of the first switch carrying abutment means which during movement of the first operating member from its first position to its second position with the second operating member in its first position, engages corresponding abutment means on the second operating member to move the second operating member from its first position to its second position, and said second operating member carrying a resilient component which, during movement of the second operating member beyond its second position to release the second switch detent means is deflected towards the first operating member so that in the event that the first operating member is in its second position, then said resilient component engages an abutment on the first operating member so as to move the first operating member with the second operating member so releasing the first switch detent means whereby both of said first and second operating members return to their first position.

Preferably, said first and second operating members are slidable parallel to one another in side by side relationship in a common body, the first and second switches thus having a common body.

Desirably deflection of said resilient component is effected by a ramp surface on the body between said first and second operating members.

BRIEF DESCRIPTION OF THE DRAWINGS

One example of the invention is illustrated in the accompanying drawings wherein.

DETAILED DESCRIPTION OF A PREFERRED EMBODIMENT

Figure 1:
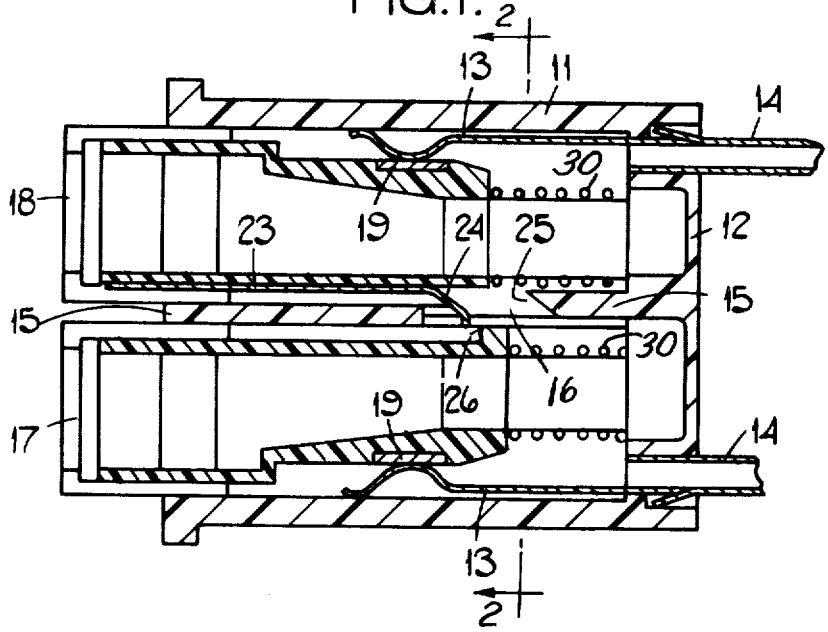
FIG. 1 is a diagrammatic sectional representation of the electrical switch assembly of FIG. 2 along section lines 1—1.
Figure 2:
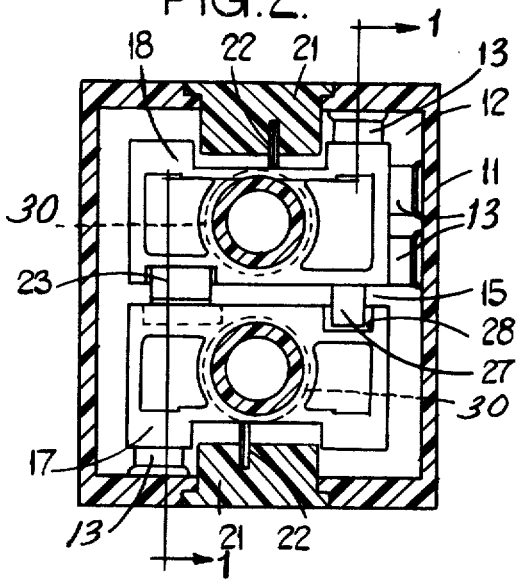
FIG. 2 is a transverse sectional view of the assembly shown in FIG. 1 along section lines 2—2.

Referring to the drawings the electrical switch assembly includes a hollow, moulded synthetic resin body 11 closed at one end by an integral apertured base 12. A plurality of terminal members extend through the apertures in the base 12 and define fixed switch contacts 13 within the body and respective terminal pins 14 externally of the body.

The body 11 is divided internally into first and second compartments by a partition wall 15 integral with and extending perpendicular to the base 12. Adjacent the base 12 the wall 15 is formed with an aperture 16.

Slidably received in one of the compartments of the body is a first switch operating member 17, a similar switch operating member 18 being received in the other compartment. The operating members 17, 18 are thus positioned side by side in the common body 11, and are slidable parallel to one another towards and away from the base 12. At their ends remote from the base 12, the operating members 17, 18 project from the open end of the body 11. Associated with each of the operating members is a compression spring (not shown) which acts between the operating member and the base 12 to urge the respective operating member outwardly of the body.

Figure 3:
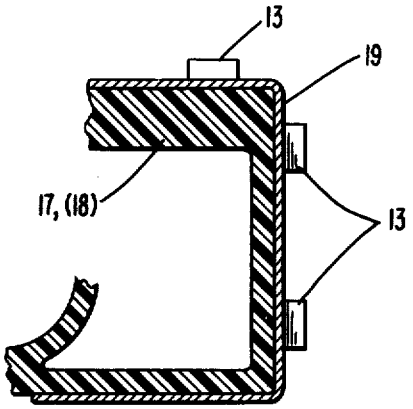
FIG. 3 is a partial view of the bridging contact in FIG. 2.

Each of the operating members carries a movable electrical contact 19 which bridges respective fixed contacts 13 to define an electrical switch as more clearly shown in FIG. 3. Thus two electrical switches are defined within the common body 11 one of the electrical switches incorporating the operating member 17 and the other incorporating the operating member 18.

Associated with each of the operating members 17, 18 is a detent mechanism whereby the operating member can be retained in a depressed position relative to the body 11 against the action of its respective spring. Upon release of the detent mechanism the respective operating member 17, 18 is moved to a projecting position wherein abutments on the operating member and the body respectively prevent further movement of the operating member against the action of the respective spring. The movable contact 19 of each of the operating members 17, 18 is so arranged in relation to its respective fixed contacts 13 that the electrical circuit therethrough is completed in the first projecting position of the respective operating member and is broken in the second, depressed position of the operating member. Thus the two electrical switches have an off position in which their respective operating member is depressed towards the base 11, and an on position in which the respective operating member projects in relation to the off position.

The detent arrangement of each of the operating members 17, 18 for retaining the operating member in its second, depressed position, is similar and is of a known form. The detent mechanism includes a cam form 21 carried by the body 11 and a resilient cam follower 22 carried by the respective operating member. The cam follower 22 of each of the operating members is defined by a peg at one end of a resilient arm extending in the direction of movement of the operating member. The peg engages, and follows a groove in the cam form 21 and the arrangement is such that when each operating member is moved from its first position to its second position against the action of the respective spring then the operating member must be moved fractionally beyond its second position in order for the peg of the cam follower 22 to engage in a retaining notch of the cam form 21. Thereafter, upon release of the operating member it will start to move back towards its first position under the action of its respective spring and will be arrested in the second position by the engagement of the peg of the cam follower 22 in the notch of the cam form 21. In order to release the detent mechanism to permit the operating member to be returned from its second, to its first position by the respective spring, the operating member must be depressed against the action of its spring beyond the second position to permit the peg of the cam follower to ride out of the notch of the cam form so that thereafter upon release of the operating member it can return unimpeded to its first position under the action of its respective spring. As mentioned above, this type of detent mechanism is well known in switches, and gives rise to the term push-push in relation to the operation of the switch.

The operating member 18 carries, on its face presented to the partition wall 15, an elongate resilient metal strip 23. The strip 23 is anchored to the operating member 18 at its end adjacent the projecting end of the operating member 18 and has an outwardly turned portion 24 at its opposite end. The outwardly turned portion 24 extends through the aperture 16 in the partition wall 15 towards the operating member 17. In the rest position of the strip 23, the strip 23 lies in contact with the side wall of the operating member 18 and the free end of the portion 24 does not engage the operating member 17.

The operating members 17, 18 are shown in FIG. 1 in their first, that is to say their projecting positions. The aperture 16 in the partition wall 15 is formed with a sloped end wall 25 which is so positioned in relation to the portion 24 of the strip 23 that it will be engaged by the portion 24 during movement of the operating member 18 beyond its second position to release the detent mechanism to permit the operating member 18 to return to its first position. The slope of the wall 25 is such that as the portion 24 of the strip 23 coacts therewith the strip 23 is deflected away from its respective operating member 18 so that the free end of the portion 24 co-operates with the operating member 17.

Figure 4:
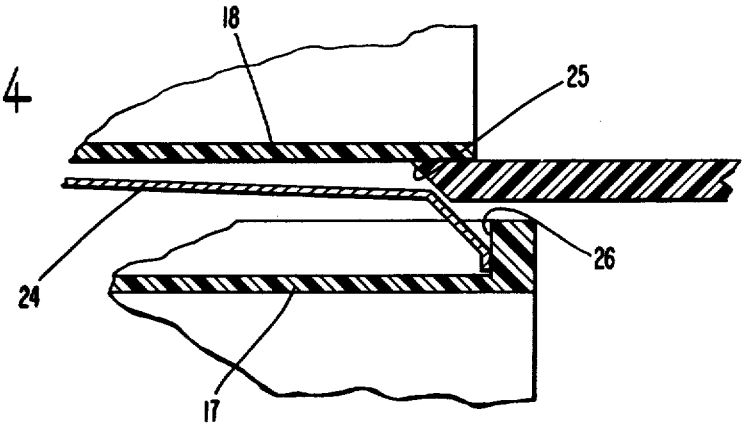
FIG. 4 is a partial view of the resilient strip of FIG. 1 in its flexed position.

The operating member 17 is formed with an external shoulder 26 which, when the operating member 17 is in its second position, can be engaged by the free end of the portion 24 of the strip 23 as the portion 24 is deflected by the ramp surface 25 as seen in FIG. 4. It will be apparent therefore that assuming that the first operating member 17 is in its second position, then when the second operating member 18 is moved beyond its second position to release the detent mechanism of the second operating member the portion 24 of the strip 23 will engage the shoulder 26 of the operating member 17 so that the operating member 17 is carried with the operating member 18 beyond its second position so releasing the detent mechanism of the operating member 17. Thereafter, upon release of the operating member 18 both the operating member 18 and the operating member 17 will be returned simultaneously to their first positions by their respective compression springs.

Figure 5:
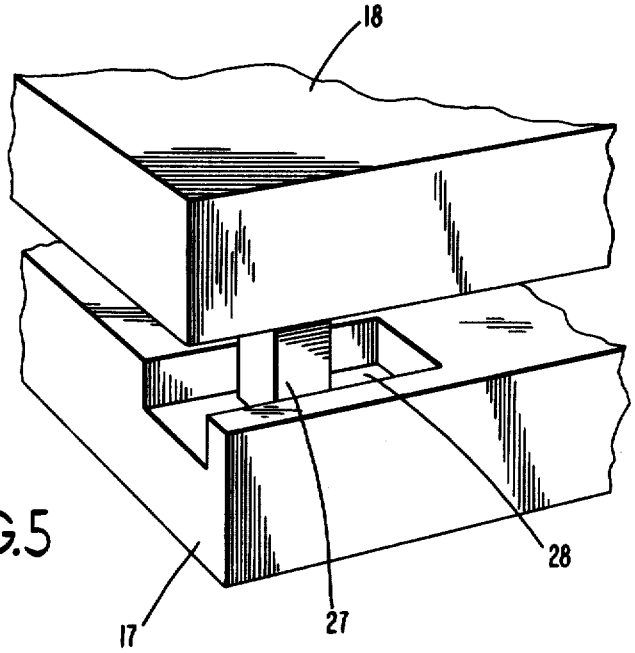
FIG. 5 is a detailed view of the peg and abutment of FIG. 2.

The partition wall 15 is formed with a second aperture (not shown) adjacent the open end of the body 11. A peg 27 integral with the operating member 18 extends through the second aperture in the partition wall 15 and into a slot or groove 28 in the operating member 17 as shown in FIG. 5. The arrangement is such that when both of the operating members 17, 18 are in their first positions then the peg 27 is abutting the axially outermost end of the groove 28 so that should the operating member 17 be moved towards its second position, then the end wall of the groove 28 abutting the peg 27 will cause the operating member 18 to be moved with the operating member 17 to their second position. However, the length of the groove 28 is such that with the operating member 17 in its first position, the operating member 18 can be moved between its first and second positions without affecting the operating member 17. Similarly, when the operating member 17 is in its first position the movement of the operating member 18 between its first and second positions does not cause the portion 24 of the strip 23 to abut the shoulder 26.

In one practical embodiment of the switch assembly described above the first switch incorporating the operating the operating member 17 controls operation of the side lights of a road vehicle and the second switch incorporating the operating member 18 controls energisation of the headlamps. Both switches have an off position as mentioned above, where the operating members are depressed against their compression springs and are retained by their respective detent mechanisms. Thus in the second position of each of the operating members 17, 18 both the side and headlamps of the vehicle will be switched off. The operating member 17 can be depressed against its spring to release the detent mechanism so permitting the operating member 17 to be moved to its first position energising the side lamps. This movement of the operating member 17 does not affect the operating member 18, and similarly the operating member 17 can be returned from its first to its second position to de-energise the side lights without affecting the operating member 18. However, assuming that the operating member 17 is in its off that is to say its second position, then if the operating member 18 is depressed beyond its second position to release the detent mechanism then as described above the operating member 17 will be similarly released and both the operating members 17 and 18 will be moved to their first positions similtaneously. Thus both headlamps and sidelamps will be energised and it will not be possible to energise the headlamps while leaving the sidelamps de-energised.

Assuming that both operating members 17, 18 are in their first positions so that the headlamps and sidelamps are energised then the operating member 18 can be moved back to its second position to de-energise the headlamps without affecting the position of the operating member 17 since the peg 27 will merely slide along the length of the groove 28. However, with both operating members in their first position should an attempt be made to move the operating member 17 to its second position to switch off the sidelamps then as described above, the end wall of the groove 28 will engage the peg 27 so that the operating member 18 is simultaneously moved to its second position thus de-energising the headlamps together with the sidelamps. It follows therefore that the headlamps can never be energised without the sidelamps being energised, and the sidelights can never be de-energised without the headlamps being de-energised.

It will be appreciated that if desired combinations of circuits other than the side and headlight circuits can be controlled in a similar manner where some correlation between the operation of the two circuits is called for.

The various contact configurations may need to be altered, but the correlation between the movements of the operating members as a result of the peg and slot 27, 28 and the strip 23 and abutment 26 will remain the same. In place of the peg and slot arrangement a similar arrangement could be provided where the peg is carried by the operating member 17 and abuts a shoulder on the operating member 18. The effect would be the same as the arrangement of the groove 28 and peg 27, as described above.

I claim:

1. An electrical switch assembly including first and second push-push switches including respective first and second detent means as hereinbefore defined, said first and second switches being positioned side by side, the operating member of the first switch carrying first abutment means which during movement of the first operating member from its first position to its second position with the second operating member in its first position, engages corresponding second abutment means on the second operating member to move the second operating member from its first position to its second position, and said second operating member carrying a resilient component which, during movement of the second operating member beyond its second position to release the second switch detent means, is deflected towards the first operating member so that in the event that the first operating member is in its second position, then said resilient component engages an abutment on the first operating member so as to move the first operating member with the second operating member so releasing the first switch detent means whereby both of said first and second operating members return to their first position.

2. An assembly as claimed in claim 1 wherein the first and second operating members are slidable parallel to one another in side by side relationship in a common body, the first and second switches thus having a common body.

3. An assembly as claimed in claim 1 or claim 2 wherein deflection of said resilient component is effected by a ramp surface on the body between said first and second operating members.

* * * * *